United States Patent [19]

Deziel

[11] Patent Number: 4,524,814

[45] Date of Patent: Jun. 25, 1985

[54] ENCLOSURE ASSEMBLY

[76] Inventor: Edward W. Deziel, 902 Felix St., West St. Paul, Minn. 55118

[21] Appl. No.: 506,728

[22] Filed: Jun. 22, 1983

[51] Int. Cl.[3] ..... E06B 9/08; E06B 9/262

[52] U.S. Cl. ..... 160/133; 160/84 R

[58] Field of Search ..... 160/84 R, 220, 133, 160/97, 99, 100, 102, 23 C

[56] References Cited

U.S. PATENT DOCUMENTS

| | | | |
|---|---|---|---|
| 2,554 | 4/1842 | Johnson | 160/23 C |
| 31,300 | 2/1861 | Cochrane | 160/133 X |
| 2,390,116 | 12/1945 | Michelman | 160/133 |
| 2,584,134 | 2/1952 | Knutsen | 160/220 |
| 2,635,685 | 4/1953 | Liebhaber | 160/84 R |

FOREIGN PATENT DOCUMENTS

| | | | |
|---|---|---|---|
| 2458944 | 6/1976 | Fed. Rep. of Germany | 160/133 |
| 1180573 | 6/1959 | France | 160/133 |

*Primary Examiner*—Peter M. Caun
*Assistant Examiner*—Cherney S. Lieberman
*Attorney, Agent, or Firm*—William L. Huebsch

[57] ABSTRACT

An enclosure assembly is provided comprising a plurality of panels, a frame defining a path mounting the panel assemblies for edgewise sliding movement across an opening through the frame, and a plurality of lengths of flexible material or screen joining adjacent panel assemblies along the track. Pairs of adjacent panels are relatively movable along the path between closed positions with the pairs of panels in edge-to-edge contact across the opening in the frame, and spaced positions with some of the panel assemblies spaced along the path and extending across the opening with the screen tensioned across the spaces between the panels; and can be moved to a position with all of the panels out of the opening.

17 Claims, 6 Drawing Figures

ENCLOSURE ASSEMBLY

TECHNICAL FIELD

This invention relates to enclosure assemblies, and in one aspect to enclosure assemblies particularly adapted for use in the windows of structures such as porches which have a large window-area to wall-area ratio.

Background Art

Typically enclosure assemblies used in the windows of structures which have a large window-area to wall-area ratio (e.g., porches, structures around swimming pools, greenhouses, and animal shelters) comprise a frame defining a through opening over which screen extends, and panels comprising sheets of transparent material (e.g., polymeric material or glass) that may be slid along tracks or pivoted at their edges between closed and open positions to respectively extend across or uncover portions of the screened opening. In their open positions, sliding panels typically cover large portions of such openings and, if such panels are large, they can be difficult to move and can stick in their tracks. Pivotal panels remain in the line of vision when they are open. With either type of panels, a designer must choose between (1) minimizing the framing around the transparent material in the panels, which maximizes the open feeling of the enclosure assembly, but limits the panel size and allows the transparent material to be more easily broken due to the minimal support by the framing; or (2) using more framing which allows larger panels to be used but reduces the visibility through or past the panels in either their open or closed positions.

DISCLOSURE OF INVENTION

The present invention provides an enclosure assembly which is particularly useful in the windows of structures where a large window-area to wall-area ratio is desired, which enclosure assembly has good strength with a minimum of framing and can be closed so that panels cover an opening, partially opened so that alternating panels and lengths of screen cover the opening, or fully opened to totally uncover the opening.

The enclosure assembly according to the present invention includes a plurality of stiff elongate generally rectangular panels, and means mounting the panels in edge-to-edge relationship for edgewise sliding movement along a predetermined path across an opening to afford relative movement of adjacent panels between (1) a closed position with panel edges of the adjacent panels together so that several pairs of adjacent panels in their closed positions can cover the opening; and (2) a spaced position with the adjacent panels spaced apart and lengths of flexible material (preferably screen) attached therebetween extending across the space between the adjacent panels so that with one or more spaced adjacent panels across the opening some of the opening will be covered only with screen. Means are provided for relatively moving adjacent panels across the opening between their closed and spaced positions, and for further moving all of the panels and lengths of flexible material or screen interconnecting them completely away from the opening so that the opening is free from any obstruction. Such means for moving the panels can comprise a frame defining the opening and the path, which frame has a top, guide means for positioning the panels across the opening one above the other with the panel edges extending horizontally and positioned vertically one above another, and support means adapted to engage and support the bottom edge on the lowermost panel of a stack of adjacent panels in their closed positions and covering the opening. Means are also included which may be in the form of a manually rotatable spindle at the top of the frame adapted to roll on the panels and their interconnecting lengths of flexible material or screen, for sequentially lifting the panels out of the top of the frame to sequentially move adjacent panels in the stack covering the opening to their spaced positions downwardly from the top of the frame until the opening is covered by adjacent panels in their spaced positions with interconnecting lengths of screen therebetween and the enclosure assembly is in one partially open position, and to subsequently lift all of the panels out of the top of the frame so that the enclosure is fully open with none of the panels or strips of flexible material extending across the opening.

The panels preferably each comprise an elongate slat that may be of an opaque, translucent, or transparent stiff polymeric material such as plexiglass or fiberglass, or which could comprise another suitable decorative material such as wood or a thermal insulating material such as polystyrene. Panels may additionally have their panel edges adapted to nest together generally in the manner of a tongue and groove to restrict movement of wind and rain therebetween when adjacent panels are in their closed positions. The lengths of flexible material are preferably of fiberglass screen because of its ability to be resiliently bent. Preferably the wider lengths of screen are held on corresponding sides of adjacent panels they interconnect by strips defining the longitudinal panel edges in a manner that allows the lengths of screen to bend generally into cylinders projecting normally from these corresponding sides when the adjacent panels they interconnect are in their closed positions, and that tensions the lengths of screen around and between the strips when the adjacent panels they interconnect are separated in their spaced positions.

BRIEF DESCRIPTION OF DRAWING

The present invention will be further described with reference to the accompanying drawing wherein like numbers refer to like parts in the several views, and wherein.

DETAILED DESCRIPTION

Figure 1:
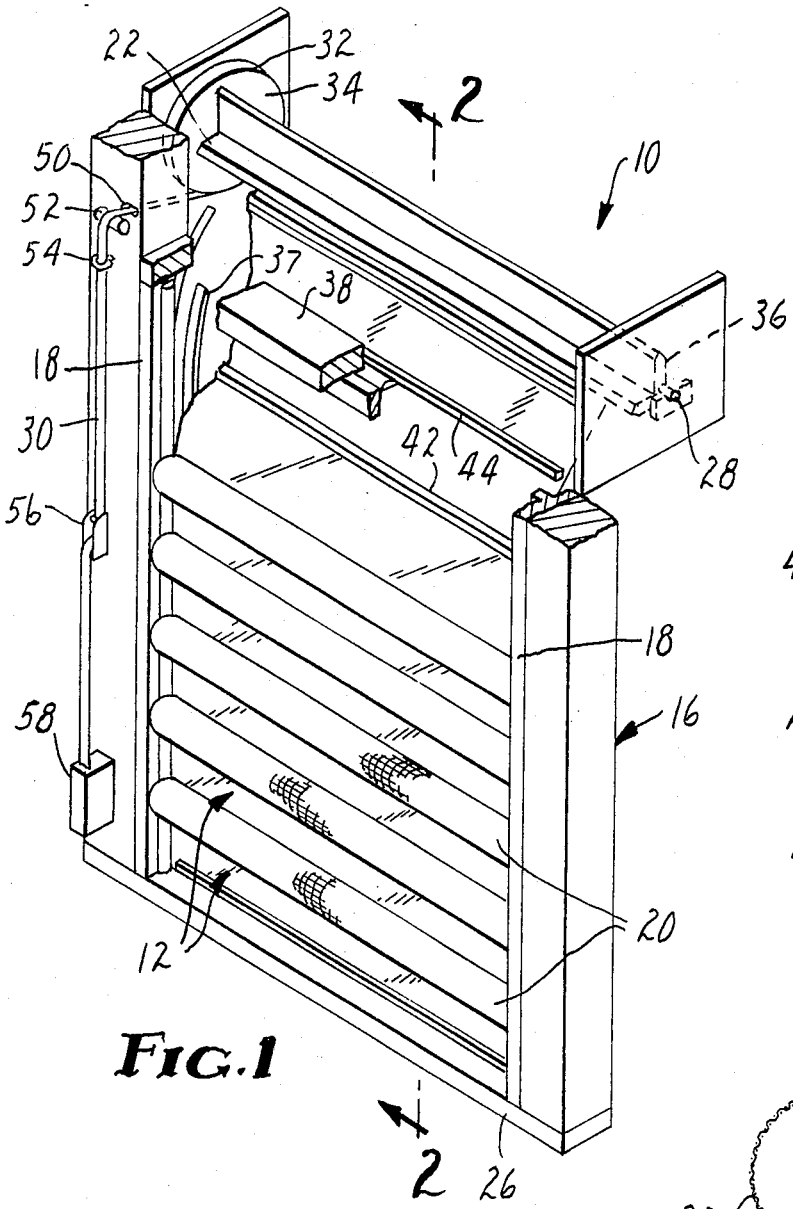
FIG. 1 is a perspective view of an enclosure assembly according to the present invention shown in a closed position and having parts broken away to show details.

Referring now to the drawing, there is shown an enclosure assembly according to the present invention generally designated by the reference numeral 10.

Figure 3:
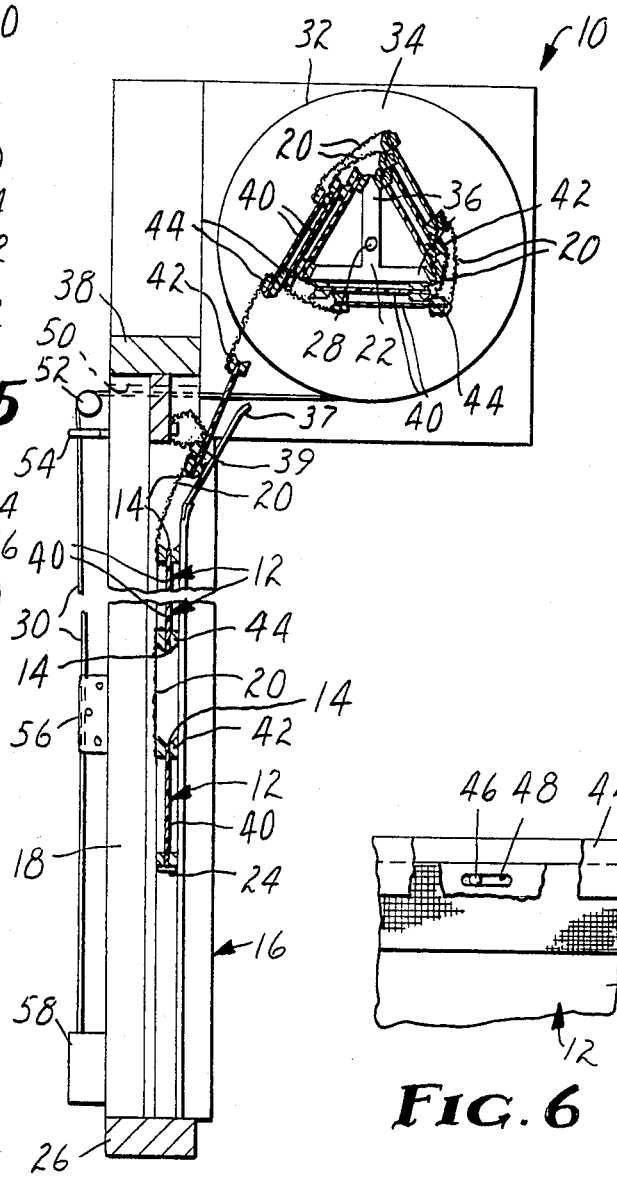

Generally the enclosure assembly 10 comprises a plurality of elongate, generally rectangular panels 12 having parallel longitudinal panel edges 14, and means in the form of a frame 16 mounting the panels 12 generally in edge-to-edge relationship for edgewise sliding movement along a predetermined path defined by two spaced opposed sets 18 of rails included in the frame 16. A plurality of elongate, generally rectangular lengths of flexible material or fiberglass screen 20 join pairs of adjacent panels 12 along the path. Each of the lengths of flexible material or screen 20 is attached between the adjacent panel edges 14 of a pair of adjacent panels 12, and at least some of the lengths of flexible material 20 have widths normal to the longitudinal panel edges 14 that afford relative movement of adjacent panels 12 they interconnect between a closed position with those adjacent panels 12 in edge-to-edge contact (see, for example, the pairs of adjacent panels 12 in FIG. 1, and the lower two adjacent panels 12 in FIG. 4), and a spaced position with the adjacent panels 12 spaced apart and the length of flexible material 20 extending across the space therebetween (see, for example, the pairs of adjacent panels 12 across the opening through the frame 16 in FIG. 3 and the top two adjacent panels 12 in FIG. 4).

Figure 2:
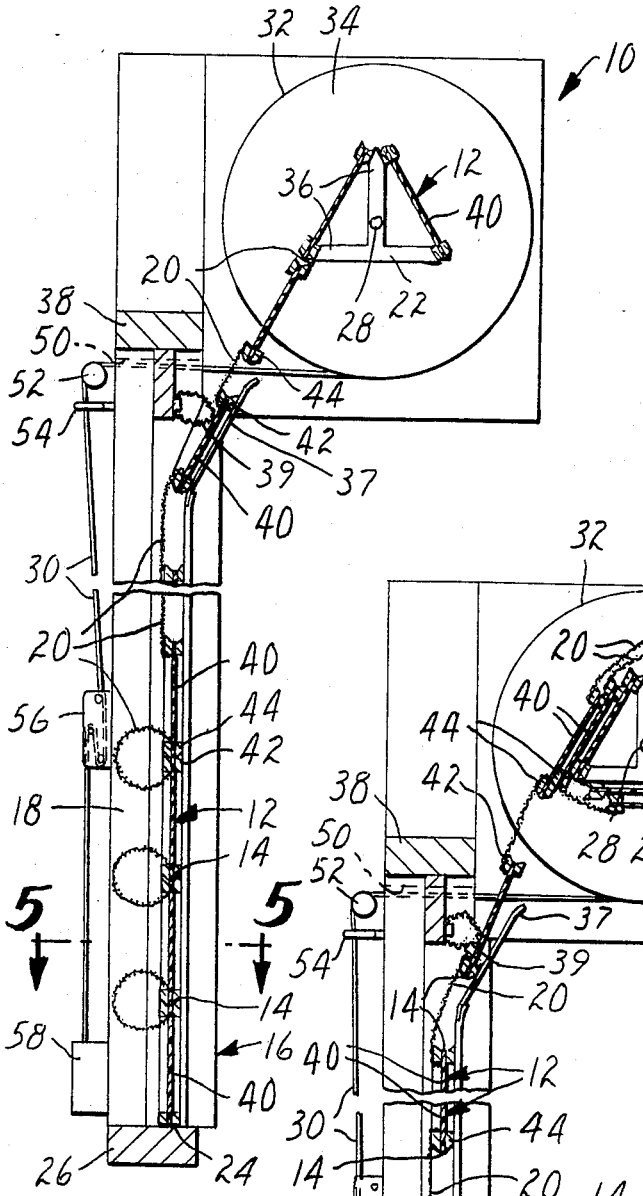
FIGS. 2 and 3 are sectional views taken approximately along line 2—2 of FIG. 1 and which respectively show the enclosure assembly in different partially open positions.

Means including a rotatable spindle 22 is provided for relatively moving the adjacent panels 12 along the path between their closed and spaced positions, and for moving the panels 12 and their interconnecting lengths of screen 20 to a position spaced from the opening through the frame 16. The two opposed sets 18 of spaced rails provide sides for the frame 16 and guide means for positioning panels 12 disposed across the opening in the frame 16 one above another with their longitudinal panel edges 14 generally vertically above each other. A horizontal bottom or sill portion 26 of the frame 16 provides support means adapted to engage and support the lower longitudinal edge 14 of the lowermost panel 12 across the central opening with a sealing strip 24 attached along that edge 14 therebetween, and to support adjacent panels 12 in their closed positions above in a stack that covers the opening. The spindle 22 is mounted adjacent the top of the frame 16 for rotation about two horizontal outwardly projecting end pins 28 defining its axis, and may be manually rotated through the use of a strap or cord 30 fixed at one end to and wrapped around the cylindrical periphery 32 of a disk 34 coaxially fixed at one end of the spindle 22. The spindle 22 is generally T-shaped in cross section to provide three axially extending support edges 36 each generally equally spaced from the pins 28 at its axis and from the other two support edges 36. One of the longitudinal edges 14 of the uppermost panel 12 is attached to one of the support edges 36 by a length of flexible material so that the spindle 22 may be rotated to wrap the panels 12 and their interconnecting lengths of flexible material 20 around the support edges 36. The widths of the three uppermost panels 12 and their interconnecting lengths of flexible material 20 are selected so that the three uppermost panels 12 can be wrapped in a generally triangular pattern around the spindle 22 (FIG. 2) with the panels 12 extending between the support edges 36 and their interconnecting lengths of flexible material 20 providing small separations and hinges around the support edges 36 between their adjacent panel edges 14. Several of the next uppermost panels 12 and their interconnecting lengths of flexible material 20 have widths selected so that those next several panels 12 will wrap around the spindle 22 in positions parallel to and overlying the three uppermost previously wrapped-on panels 12 (FIG. 3) so that (1) they are supported over their full width on the spindle 22, (2) the panels 12 already wrapped around the spindle 22 will interlock with the next panel 12 being wrapped on in the manner of a tooth with a sprocket wheel to help lift them and so that the panels 12 will descend smoothly along the path when they are unwound, and (3) the panels 12 will form a reasonably compact wrap around the spindle 22 about which the lowermost panels 12 can wrap in a similar or less orderly fashion.

The frame 16 also has a horizontal top portion 38 which with the side and sill portions 18 and 26 define the central through opening. The top portion 38 supports a cylinder 39 of resiliently flexible material (e.g., fiberglass screen) adjacent the path that will press against and make bug-restricting sealing engagement with one of the panels 12 or lengths of flexible material 20 along an adjacent portion of the path which is defined by arcuate spaced strips 37 directed toward the spindle 22. The frame 16 may be of conventional wooden construction and is adapted to be mounted in a window through a wall in a conventional manner, such as by nailing or adhesives.

Figure 4:
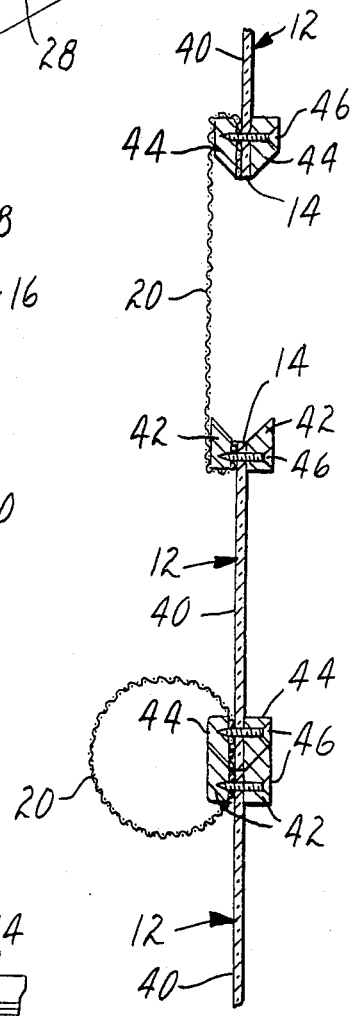
FIG. 4 is an enlarged fragmentary sectional view of the enclosure assembly of FIG. 1 showing two lower adjacent panels in a closed position and two upper adjacent panels in a spaced position.

As is best seen in FIG. 4, the panels 12 each comprise an elongate, generally rectangular slat 40 which may be of a transparent or translucent stiff, strong polymeric material such as a polymethyl methacrylate, a polystyrene, or a polyformaldehyde, and two pairs of strips 42 and 44 (e.g., of wood), each pair being on opposite sides and defining a different longitudinal panel edge 14.

The longitudinal panel edges 14 defined by the strips 42 are generally V-shaped in cross section. The longitudinal panel edges 14 defined by the strips 44 project outwardly and are adapted to fit into the V-shaped longitudinal edges 14 of adjacent panels 12 defined by the strips 42 generally in the manner of a tongue and groove to provide a degree of weather tightness when pairs of adjacent panels 12 are in the closed position (see the bottom pair of adjacent panels 12 in FIG. 4).

Each of the wider lengths of screen 20 that are used to join the lowermost pairs of adjacent panels 12 has opposite edge portions each held between different ones of the adjacent strips 42 and 44 and the corresponding surfaces of the slats 40 included in the pair of adjacent panels 12 it interconnects with edges of the screen 20 generally aligned with and adjacent the panel edges 14 of the pair of adjacent panels 12. The length of flexible screen 20 thus held along its opposite edge portions is sufficiently flexible that it will assume generally a cylindrical shape projecting from corresponding side surfaces of the pair of adjacent panels 12 it interconnects when those panels 12 are in their closed position (see the strip of flexible material 20 connected between the bottom pair of panels in FIG. 4); and will be tensioned around and between the strips 42 and 44 under which its end portions are fastened when the pair of adjacent panels 12 it interconnects are in their spaced position (see the strip of flexible material 20 connected between the top two panels 12 in FIG. 4). The lengths of flexible material 20 can be thus fastened against the surfaces of the slats 40 facing indoors, as illustrated, or alternatively against the sides facing outside. The enclosure assembly 10 has a more pleasing appearance from the inside when the lengths of flexible material 20 are fastened on the outside surfaces, however, the cylindrical lengths of screen 20 between closed pairs of panels 12 can collect snow, etc., when so disposed.

The lengths of flexible material 20 that connect the uppermost pair of adjacent panels 12 serve primarily as hinges to wrap around the support edges 36 to afford wrapping the uppermost panels 12 around the spindle 22, and thus, as illustrated, may have their edge portions retained under the strips 42 and 44 with their edges on the side of the strips 42 and 44 opposite the panel edges 14 defined by those strips 42 and 44.

Figure 5:
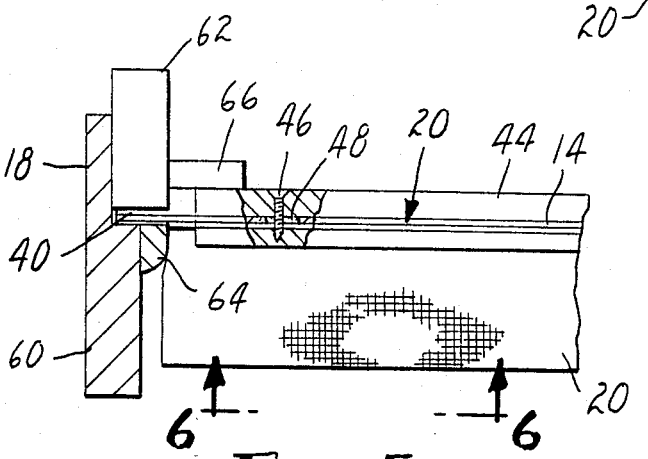
FIG. 5 is an enlarged sectional view taken approximately along line 5—5 of FIG. 2.
Figure 6:
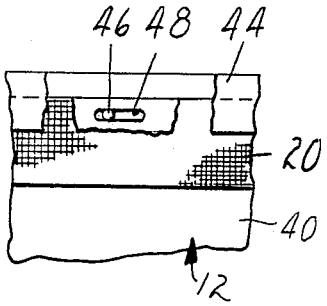
FIG. 6 is a fragmentary sectional view taken approximately along line 6—6 of FIG. 5.

As is best seen in FIGS. 4, 5 and 6, the strips 42 and 44 are fastened to the slats 40 by fastening members or screws 46 that fasten opposed pairs of strips 42 or 44 to each other through openings 48 in the slat 40 therebetween. As seen in FIG. 6, the openings 48 are elongated in a direction parallel to the longitudinal panel edges 14 to afford relative longitudinal thermal expansion and contraction of the slats 40 and strips 42 and 44 without stressing the slats 40.

The strap 30 by which the spindle 22 is rotated to wrap on the panels 12, or is allowed to rotate because of the weight of the lowermost panels 12 so that the panels 12 unwrap from around the spindle 22, is guided along a path by means including the periphery 32 of the disk 34, an opening 50 through one of the vertical side portions 18 of the frame 16 aligned with the periphery 32 of the disk 34, a roller 52 rotatably mounted on the frame 16 around which the strap 30 changes direction about 90 degrees, and an annular eye 54 anchored in the frame 16 closely adjacent the roller 52 which maintains the wrap of the strap around the roller 52. A brake device 56 through which the strap 30 is threaded in a generally Z-shaped path around pins is fixed on the frame 16 spaced from the eye 54 and restricts rapid through movement of the strap 30 to slow unwrapping of the panels 12 from around the spindle 22 should the strap 30 be inadvertently released. Also, a spring-biased take-up device 58 is fixed to the frame 16 in which the distal end of the strap 30 is wound and which applies a tension to the strap 30 that in combination with the effect of the brake device 56 ensures that the panel assemblies 12 cannot unwind from the spindle 22.

As is best seen in FIG. 5, which shows one set 18 of rails (the other set 18 being a minor image thereof), the two spaced opposed sets 18 of rails that provide the sides for the frame 16 and define the path for the panels 12 each include lapped boards 60 and 62 and an inside trim strip 64 which define a track for end portions of the slats 40 that extend a short distance beyond the ends of the strips 42 and 44, and an outside facing board 66 that projects from the board 62 a short distance along the strips 42 and 44 on the outer surfaces of the panels 12. The strips of flexible screen 20 are slightly longer than the edge strips 42 and 44 so that edge portions of the lengths of screen 20 project beyond the ends of the strips 42 and 44 can resiliently press against the inner surfaces of the trim strips 64 to provide bug-restricting seals therebetween.

Operation

To operate the enclosure assembly 10 (assuming it is initially closed) a person simply pulls on the portion of the strap 30 between the eye 54 and the brake device 56 which unwind the strap 30 from the periphery 32 of the disk 34, causing the spindle 22 to rotate and wrap on the uppermost panels 12. As the panels 12 are wrapped around the spindle 22, they will be sequentially lifted out of the path across the opening through the frame 16 starting from the top down, thereby causing sequential separation of the longitudinal panel edges 14 of pairs of adjacent panels 12 and movement of those pairs of adjacent panels 12 to their spaced positions sequentially from the top down to tension the lengths of flexible material or screen 20 therebetween. The user can stop rotating the spindle 22 when he has moved a desired number of the pairs of adjacent panels 12 to their spaced positions to provide a desired amount of ventilation through the lengths of screen 20, or can continue to rotate the spindle 22 to lift the lowermost panel 12 partially (FIG. 3) or completely (not shown) out of the opening. The strap 30 can then be pulled through the brake device 56 and allowed to wind up in the take-up device 58 which, acting through the brake device 56, will retain the panels 12 where desired. Subsequently the strap 30 can be pulled from the take-up device 58, pulled back through the brake device 56, and allowed to be wound back on the disk 34 by the weight of the lowermost panels 12 so that panels 12 will be unwound from around the spindle 22, will move back into the track, and then, sequentially, pairs of adjacent panels 12 will move to their closed position after the lowermost panel 12 reaches the sill portion 26 of the frame 16.

The present invention has now been described with reference to one embodiment thereof. It will be apparent to those skilled in the art that many modifications can be made to the enclosure assembly 10 without departing from the spirit of the present invention. For example, with proper modifications, the assembly can be adapted for use over horizontally disposed openings. Thus, the scope of the claims to the present invention should not be limited to the specific structure illustrated, but should include all structures described by the language of the claims and their equivalents.

I claim:

1. An enclosure assembly comprising a plurality of stiff elongate generally rectangular panels having parallel longitudinal panel edges;

means mounting said panels generally in edge-to-edge relationship for edgewise movement along a predetermined path in directions normal to said panel edges;

a plurality of elongate, generally rectangular lengths of flexible material joining adjacent panels along said path, each of said lengths of flexible material being attached between two adjacent panels and at least some of said lengths having a width normal to the panel edges of adjacent panels affording relative movement of said adjacent panels between a closed position with the panel edges in contact, and a spaced position with the panel edges spaced apart and the strip of flexible material therebetween extending across the space between said adjacent panels, at least some of said lengths of flexible material joining adjacent panels being screen and each having opposite parallel longitudinal screen edges and screen edge portions adjacent said screen edges; means along said panel edges for attaching said screen edge portions to said adjacent panels with the screen edges adjacent the panel edges of the adjacent panels to form said lengths of screen generally into a cylinder projecting normally from said corresponding surfaces when said adjacent panels are in said closed position, and to tension said length of screen around and between said means for attaching along the panel edges of said adjacent panels when said adjacent panels are in said spaced position; and means for relatively moving said panels along said path between said closed and spaced positions.

2. An enclosure assembly according to claim 1 wherein said means for mounting said panels comprises a frame defining a central through opening, having a top, guide means for positioning panels disposed across said opening one above another with the panel edges of said panels generally vertically above each other, and support means adapted to support the lowermost panel of a stack of adjacent panels in said closed positions and covering said opening; and said means for relatively moving said panels comprises means for sequentially lifting panels out of the top of said frame to sequentially move adjacent panels in said stack to said spaced position downwardly from the top of said frame.

3. An enclosure assembly according to claim 2 wherein said means for sequentially lifting is adapted to lift all of said panels out of the top of said frame to completely remove said panels from across said opening.

4. An enclosure assembly according to claim 2 wherein said means for sequentially lifting comprises a spindle rotatably mounted adjacent the top of said frame about a horizontal axis, said spindle having axially extending support edges each about equally spaced from the axis, the uppermost of said panels being attached along its uppermost edge to said spindle so that said spindle may be rotated to wrap said panels and strips of flexible material around said support edges, said attachment, the width of the uppermost panels and the widths of the strips of flexible material connecting several of the uppermost panels being selected to position said strips of flexible material around said support edges and said panels between said support edges as said uppermost panels and strips of flexible material are wound about said spindle.

5. An enclosure assembly according to claim 1 wherein adjacent panel edges of adjacent panels are shaped to make tongue and groove-like engagement when said adjacent panels are in said closed position.

6. An enclosure assembly according to claim 1 wherein said panels comprise light-transmitting material.

7. An enclosure assembly according to claim 1 wherein said screen is of fiberglass.

8. An enclosure assembly according to claim 1 wherein said panels are of thermal insulating material.

9. An enclosure assembly comprising a plurality of stiff elongate generally rectangular panels having parallel longitudinal panel edges, each of said panels comprising an elongate generally rectangular slat and spaced strips attached to said slat with each strip helping to define one of said panel edges;

means mounting said panels generally in edge-to-edge relationship for edgewise movement along a predetermined path in directions normal to said panel edges;

a plurality of elongate, generally rectangular lengths of flexible material joining adjacent panels along said path, each of said lengths of flexible material being attached between two adjacent panels, at least some of said lengths having a width normal to the panel edges of adjacent panels affording relative movement of said adjacent panels between a closed position with the panel edges in contact, and a spaced position with the panel edges spaced apart and the strip of flexible material therebetween extending across the space between said adjacent panels, and at least some of said lengths of flexible material joining adjacent panels being screen and each having opposite parallel longitudinal screen edges and screen edge portions adjacent said screen edges, which screen edge portions are each held between different ones of the adjacent strips and corresponding surfaces of the slats included in said adjacent panels with the screen edges adjacent the panel edges of the adjacent panels to form said lengths of screen generally into a cylinder projecting normally from said corresponding surfaces when said adjacent panels are in said closed position, and to tension said length of screen around and between the strips along the panel edges of said adjacent panels when said adjacent panels are in said spaced position; and means for relatively moving said panels along said path between said closed and spaced positions.

10. An enclosure assembly according to claim 1 wherein said means for mounting said panels comprises a frame defining a central through opening, having a top, guide means for positioning panels disposed across said opening one above another with the panel edges of said panels generally vertically above each other, and support means adapted to support the lowermost panel of a stack of adjacent panels in said closed positions and covering said opening; and said means for relatively moving said panels comprises means for sequentially lifting panels out of the top of said frame to sequentially move adjacent panels in said stack to said spaced position downwardly from the top of said frame.

11. An enclosure assembly according to claim 10 wherein said means for sequentially lifting is adapted to lift all of said panels out of the top of said frame to completely remove said panels from across said opening.

12. An enclosure assembly according to claim 10 wherein said means for sequentially lifting comprises a spindle rotatably mounted adjacent the top of said frame about a horizontal axis, said spindle having three axially extending support edges each about equally spaced from the axis and from the other two support edges, the uppermost of said panels being attached along its uppermost edge to said spindle so that said spindle may be rotated to wrap said panels and strips of flexible material around said support edges, said attachment, the width of the uppermost panels and the widths of the strips of flexible material connecting several of the uppermost panels being selected to position said strips of flexible material around said support edges and said panels between said support edges as said uppermost panels and strips of flexible material are wound about said spindle.

13. An enclosure assembly according to claim 1 wherein said panels each comprise a strip on both sides of said slat along each of said longitudinal panel edges, said strips along adjacent panel edges of adjacent panels being shaped to make tongue and groove-like engagement when said adjacent panels are in said closed position.

14. An enclosure assembly according to claim 1 wherein said panels each comprise a strip on both sides of said slat along each of said longitudinal panel edges, and fastening members fastening said strips along each panel edge to each other through openings in said slats, said openings being elongated parallel to said panel edges to afford relative longitudinal thermal expansion and contraction of said slats and strips.

15. An enclosure assembly according to claim 1 wherein said panels comprise light-transmitting material.

16. An enclosure assembly according to claim 1 wherein said screen is of fiberglass.

17. An enclosure assembly according to claim 1 wherein said panels are of thermal insulating material.

* * * * *